United States Patent [19]

Slaats et al.

[11] 4,155,083

[45] May 15, 1979

[54] COMPOSITE WIRE AND FENCE MADE THEREFROM USEFUL FOR SECURITY PURPOSES

[75] Inventors: Joris Slaats, De Pinte; Jan Vandenbogaerde, Waarmaarde, both of Belgium

[73] Assignee: N. V. Bekaert S. A., Zwevegem, Belgium

[21] Appl. No.: 791,046

[22] Filed: Apr. 26, 1977

[30] Foreign Application Priority Data

May 31, 1976 [NL] Netherlands ..... 7605870
Sep. 9, 1976 [NL] Netherlands ..... 7601670

[51] Int. Cl.[2] ..... G08B 13/22

[52] U.S. Cl. ..... 340/666; 340/541; 340/564

[58] Field of Search ..... 340/272, 273, 258 C, 340/258 R, 261, 285, 666, 541, 564

[56] References Cited

U.S. PATENT DOCUMENTS

| | | | |
|---|---|---|---|
| 2,101,040 | 12/1937 | Bayley et al. | 340/273 |
| 3,696,373 | 10/1972 | Dunn et al. | 340/273 |
| 3,803,548 | 4/1974 | Skujins, Jr. | 340/261 |
| 4,040,044 | 8/1977 | Laymon et al. | 340/261 |

*Primary Examiner*—Glen R. Swann, III
*Attorney, Agent, or Firm*—Edward J. Brenner

[57] ABSTRACT

At least two conductive wire elements which are separated from each other by a thin insulating layer such that as soon as a pressure is exerted on the composite wire at least one of the electrical characteristics, contact resistance and/or capacitance between the elements, changes to a measurable extent. A fence constructed of such composite wire has a circuit connected with both conductive wire elments for detecting any deviation in the nominal value of contact resistance and/or capacitance between them and for controlling an alarm circuit responsive to such deviation.

10 Claims, 8 Drawing Figures

COMPOSITE WIRE AND FENCE MADE THEREFROM USEFUL FOR SECURITY PURPOSES

BACKGROUND OF THE INVENTION

The invention relates to a composite wire comprising a number of elongated conductive elements and adapted for use in a security fence.

It is a known practice to make fences by means of wires, particularly composite wires. However, such known fences are not entirely secure. Thus, it is possible to break through or climb them without being detected, particularly in cases where the fences are often set up around very large estates or grounds so that permanent guard surveillance of the whole fence is nearly impracticable.

It is also known to use detectors in connection with fences. A fence of the type whereby any movement of the thread-formed fence elements is detected by movement-sensing detectors is described in U.S. Pat. No. 3,634,638.

Although such a fence generally offers good protection, in principle, it is possible to break through the fence by clamping some of the wires to two posts located between the movement-sensing switches and subsequently cutting said wires between said posts. Since the wires are clamped to the posts at both sides of the place of cutting, the switches will not react to this cutting and the action of breaking through the fence will not be detected.

SUMMARY OF THE INVENTION

It is an object of the invention to obviate the disadvantage mentioned above and to provide a wire for a fence of the aforesaid type, whereby any action on the wire itself is detected, so that the fence provided with such wires is substantially more secure.

It is a further object of the present invention to provide a composite wire for such a fence, which, if applied in such a fence, renders any attack on the fence detectable. According to the invention at least two of the elements are separated from each other by a thin insulating layer, so that as soon as a pressure is exerted on the composite wire at least one of the electric characteristics, compact resistance and/or capacity between the elements, changes to a measurable extent.

Any attempt to cross the fence will inevitably go together with the exertion of a pressure on the wire applied in the fence and will thus be detected. The application of the wire according to the present invention thus allows to make fences of any desired type, which are considerably more secure than prior art fences.

The wire may comprise a first central thread-formed conductor enveloped in a thin layer of insulation material and a number of second conductors wound around the first.

The wire may also comprise a number of conductive elements twisted into a strand, of which at least one is separated from the others by an insulating layer.

Preferably, the composition and thickness of the insulation material are such that when a pressure is applied on the conductor, there mainly is a change in compact resistance between the conductors.

The present invention also covers a fence comprising a wire of the aforesaid type, a circuit connected with both conductors for detecting a deviation in the nominal value of the compact resistance and/or the capacity between them, and an alarm circuit controlled by this circuit.

The fence may also be made in such a way that one or more wires in the form of a mesh are placed in a support, which may be formed by a frame.

The fence may also comprise a number of solid elements made from hardening material in which at least one wire is embedded.

BRIEF DESCRIPTION OF THE DRAWINGS

The invention will be best understood by reference to the drawings in which.

DESCRIPTION OF THE PREFERRED EMBODIMENTS

Figure 1:
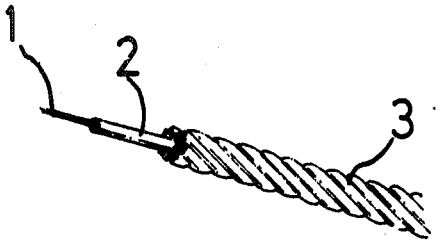
FIG. 1 is a perspective view of a first embodiment of a composite wire made according to the present invention.

FIG. 1 shows a first embodiment of such a wire. It comprises a central conductor 1 disposed in an insulating sleeve 2, the whole being enveloped by strands or conductors 3. It is also possible to make the wire by omitting the central conductor 1 and the insulating sleeve 2 and by enveloping one of the wires of the strand 3 in a thin insulating layer.

When applying a pressure on the strand 3, the insulating layer 2 is modified in such a way that the contact resistance between the wire 1 and the strands 3 is noticeably reduced. This can be detected by a suitable detector circuit.

Figure 2:
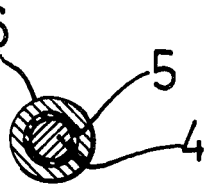
FIG. 2 is a cross-sectional view of a second embodiment of the wire made according to the present invention.

FIG. 2 shows a cross-section of another embodiment according to the invention. It comprises a central conductor 4, an enveloping layer of insulation material 5 and a metal outer sleeve 6.

The effect of pressure on the wire in this case also produces a noticeable change in contact resistance between the conductors 4 and 6.

The wires described above can be made in a simple and inexpensive manner. This particularly holds for the embodiment of FIG. 1 which can be made on existing simple cabling machines. The core conductor 1 with the insulating layer 2 is placed on the spool which normally carries the central strand, whereas the other strands 3 are placed on the other spools of the cabling machine.

Figure 3:
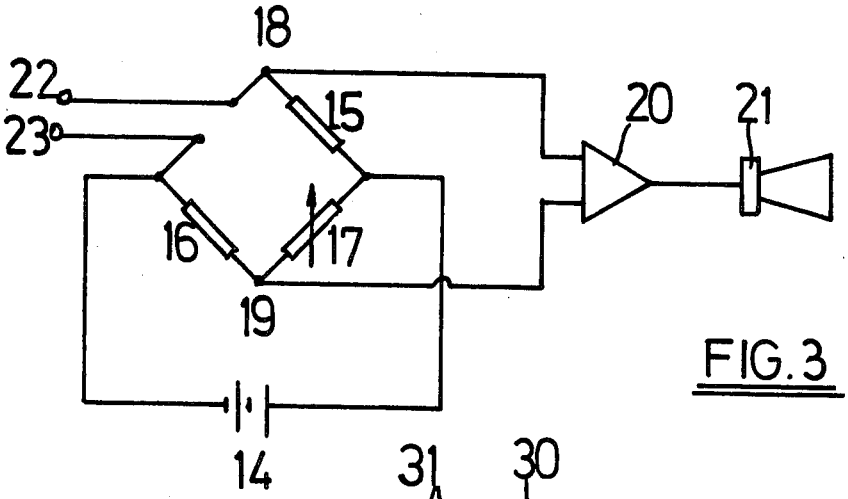
FIG. 3 is a block diagram of an alarm circuit applied in combination with such a wire.
Figure 8:
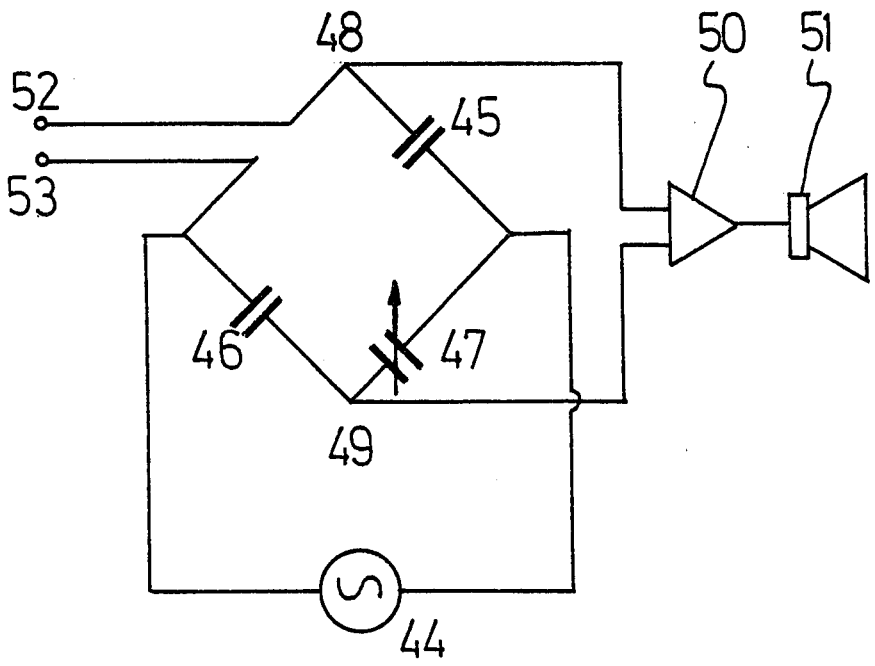
FIG. 8 is a block diagram of another alarm circuit applied in combination with such a wire.

FIG. 3 shows a block diagram of an alarm circuit to be connected to the wires according to the present invention. It comprises a resistance bridge powered by battery 14, with fixed resistors 15 and 16 and an adjustable resistor 17. The output terminals 18, 19 are connected with the amplifier 20 to whose output the klaxon 21 is connected. The central conductors of the wires are connected to lead 22 and the outer conductors of the wires to lead 23. Normally, this means that when no pressure is applied on the wires, the bridge is kept in balance by means of the resistor 17 and there is no output signal between the leads 18 and 19. When a pressure is applied on one of the wires of the fencing installation, the resistance between the leads 22 and 23 decreases thus upsetting the bridge balance and causing voltage potential differences between the terminals 18 and 19. This activates the amplifier 20 and the alarm 21. FIG. 8 shows a block diagram of another alarm circuit to be connected to the wires according to the present invention, which includes power source 44, fixed capacitors 45 and 46, variable capacitor 47, output terminals 48 and 49, amplifier 50, klaxon 51 and leads 52 and 53.

Figure 4:
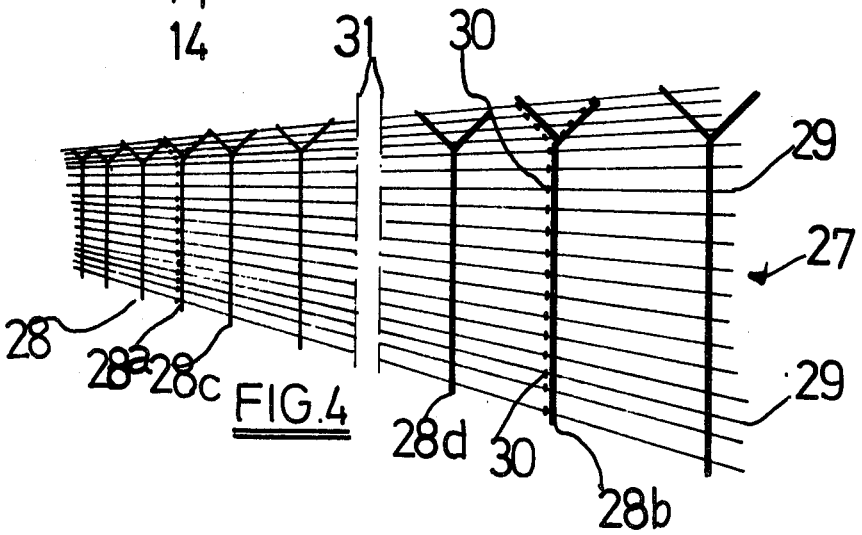
FIG. 4 is a perspective view of a fence provided with wires according to the present invention.

FIG. 4 shows a fence 27 comprising a number of posts 28 between which wires 29 are tensioned. The wires are connected to movement-sensitive switches 30 provided on a number of regularly spaced posts for example posts 28*a* and 28*b*. These switches are known (e.g., U.S. Pat. No. 3,634,638) and do not react to slow changes to the positions of the wires connected to them (evidently within certain limits), but they do react to swift changes. Variations in fence temperature do not affect the installation. However, the weight of a person intending to climb the fence or the weight of an object placed against it do activate the switches 30.

It is imaginable that such a fence may be crossed by clamping the wires to the posts 28*c*, 28*d* located between the posts 28*a*, 28*b* which are provided with switches, by means of a suitable clamp, and subsequently cutting the wires between the posts 28*c* and 28*d*, say in the area indicated by the chain lines 31.

By using wires according to the present invention this eventuality may be prevented. Any action on the fence will be detected immediately.

Figure 5:
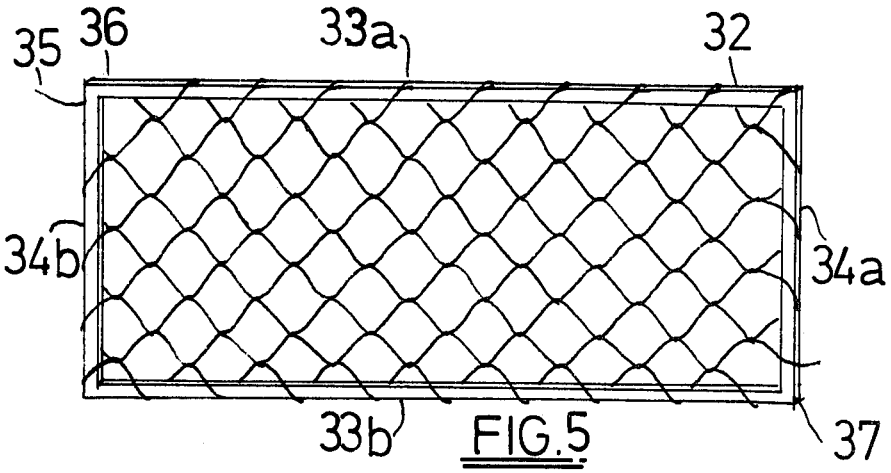
FIG. 5 is a front view of a fence element according to a second embodiment, also provided with a wire according to the present invention.
Figure 6:
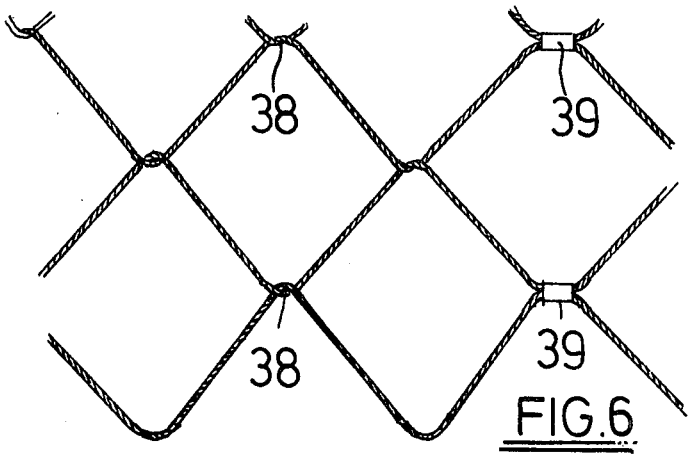
FIG. 6 is a detailed view at a larger scale of the fence shown in FIG. 7.

FIG. 5 is a front view of a fence element 32, comprising a frame having long sides 33*a*, 33*b* and short sides 34*a*, 34*b*. This frame 32 comprises, in the form of a mesh, a wire 35 according to the invention; the wire starts in the left top corner 36 and leaves the panel in the right bottom corner 37. As the figure shows, the wire is incorporated in the frame 32 in the form of a mesh. FIG. 6 is a larger scale view of the mesh formation. It is possible to form the meshes by twisting the wires, as designated by reference No. 38, about each other; however, it is also possible to form the meshes by using connecting sleeves 39 which form the corners of the meshes.

It is clear that a fence comprising a number of the above-described panels containing wires that are connected in series and to a detection circuit of the kind described in FIG. 3, may be made in a fast and inexpensive way, while still offering optimal security.

Figure 7:
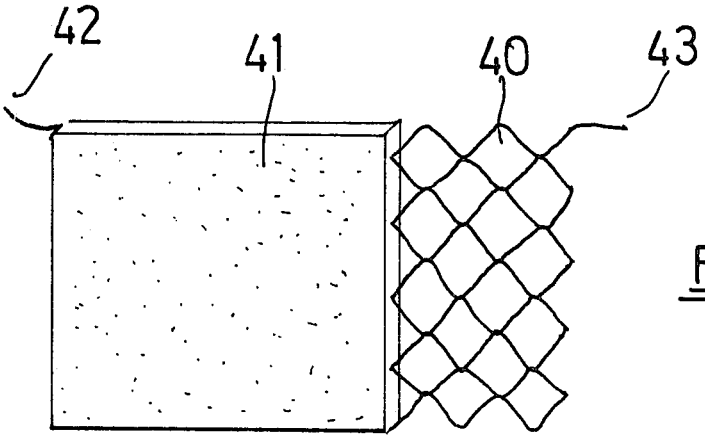
FIG. 7 is a perspective view of a third embodiment of a fence provided with wires according to the present invention.

It is also possible to embed the wire, either in a mesh configuration or in another configuration, into a solid made of a hardening material, such as synthetic material or concrete. FIG. 7 illustrates this possibility. The figure shows the mesh configuration 40 of the wire according to the invention, embedded in the slab 41, which, as said may be made of concrete or suitable synthetic material. The figure is a partly sectional elevation of the slab 41 revealing the mesh configuration. The input end of the wire is at the point 42, the output end at point 43. A number of these elements may also in this case be connected in series or in parallel. Such an embodiment is particularly suited to be embedded and to provide in this way an above-ground fence with an impenetrable extension underground.

Thus, it will be seen that the present invention provides a composite wire for use in a fence, with the wire being built in such a way that when a pressure is applied on the wire at least one of the electrical properties, contact resistance and/or capacity between the elements, changes to a measurable extent. This offers the certainty that any action on a fence comprising such a wire or such wires will be detected immediately. This therefore means that it is impossible to climb, destroy or act in any other way on such a fence without being detected.

What is claimed is:

1. A composite wire comprising a number of elongated conductive elements adapted for use in a security fence, at least two of said elements being separated from each other by a thin insulating layer such that as soon as a pressure is exerted on the composite wire the contact resistance between said elemens changes to a measurable extent.

2. A wire according to claim 1 comprising a first central thread-formed conductor enveloped in a thin layer of insulating material and a number of second conductors wound around said first conductor.

3. A wire according to claim 1 comprising a number of conductive elements twisted into a strand of which at least one is separated from the others by an insulating layer.

4. A fence comprising a wire as set forth in claim 1, a circuit connected with both of said two conductive elements for detecting any deviation in the nominal value of the contact resistance between them, and an alarm circuit controlled by this circuit.

5. A fence according to claim 4 including posts for supporting said wire under tension wherein the wires tensioned between said supporting posts are connected to movement-sensing detectors.

6. A fence according to claim 4 wherein one or more wires are incorporated in a support in the form of a mesh.

7. A fence according to claim 6 wherein said support is formed by a frame.

8. A fence according to claim 4 which includes a solid element made from a hardening material in which at least one wire is embedded.

9. A composite wire comprising a number of elongated conductive elements adapted for use in a security fence, at least two of said elements being separated from each other by a thin insulating layer such that as soon as a pressure is exerted on the composite wire the capacitance between said elements changes to a measurable extent.

10. A fence comprising a wire as set forth in claim 9, a circuit connected with both of said conductive elements for detecting any deviation in capacitance between them, and an alarm controlled by this circuit.

* * * * *